United States Patent [19]

Schroeer

[11] Patent Number: 4,694,495

[45] Date of Patent: Sep. 15, 1987

[54] INTEGRABLE CIRCUIT FOR IDENTIFYING A PILOT TONE

[75] Inventor: Bernhard Schroeer, Emmendingen, Fed. Rep. of Germany

[73] Assignee: Deutsche ITT Industries GmbH, Freiburg, Fed. Rep. of Germany

[21] Appl. No.: 831,974

[22] Filed: Feb. 20, 1986

[30] Foreign Application Priority Data

Feb. 21, 1985 [DE] Fed. Rep. of Germany ..... 3505950

[51] Int. Cl.[4] ..... H04H 5/00

[52] U.S. Cl. ..... 381/15; 381/4

[58] Field of Search ..... 324/78 D, 79 D, 78 Q, 324/77 E; 364/724, 723; 381/15, 3, 4, 5

[56] References Cited

U.S. PATENT DOCUMENTS

| | | | |
|---|---|---|---|
| 4,021,653 | 5/1977 | Sharp et al. | 324/78 D |
| 4,197,525 | 4/1980 | Biery, Jr. et al. | 324/78 D |
| 4,216,463 | 8/1980 | Backof, Jr. et al. | 324/78 D |
| 4,358,733 | 11/1982 | Hanahara | 324/77 E |
| 4,614,909 | 9/1986 | Järvfält | 364/724 |

OTHER PUBLICATIONS

Winterer, "Signal Prozessor lö t rechenintensive Probleme", Elektronik, 22/2-11, 1984, pp. 143-151, (Nov. 2, 1984).

*Primary Examiner*—Forester W. Isen
*Attorney, Agent, or Firm*—Thomas L. Peterson

[57] ABSTRACT

A circuit serves to extract one of two or more pilot tones which are modulated on an audio-frequency signal to select an appropriate decoder, and which cause a changeover to the appropriate decoder or of a decoding signal processor. To this end, one of the stereo signals is digitized by means of a clocked analog-to-digital converter, and the audio signal is separated from the pilot-signal-containing component by means of a pilot-tone-range filter and then averaged over a number of clock periods of the analog-to-digital converter by means of a sampling averager. The output signal of the averager is applied to the inputs of pilot-tone filters, then rectified to measure the signal energy, and applied to the inputs of low-pass filters. The outputs of the low-pass filter control a logic circuit which causes the two audio-frequency signals to be applied to the input of the appropriate decoder.

11 Claims, 12 Drawing Figures

INTEGRABLE CIRCUIT FOR IDENTIFYING A PILOT TONE

BACKGROUND OF THE INVENTION

The invention pertains to an integrable circuit for identifying a pilot tone from a number of pilot tones contained in an audio-frequency signal by means of pilot-tone filters tuned to the individual pilot tones.

Such a pilot tone is used, for example, to identify the stereo signal of a stereo broadcasting system, as is described in European Pat. No. 0 047 522. Since different stereo broadcasting systems are currently in use, it is at least desirable to have an automatic changeover facility at the receiving end which ensures that the stereo signal is decoded in a suitable manner even if there is a change to a transmitter of a different stereo system.

In the U.S.A., for example, different stereo-broadcast techniques are currently in use. In these techniques, the sum signal (L+R) is transmitted using amplitude modulation because compatibility with existing AM mono receivers is required. The difference signal (L−R) is transmitted using frequency, phase, or quadrature modulation. A survey of these techniques can be found, for example, in the Apr. 26, 1982 issue of the "Electronic Engineering Times" on pages 18 and 20. According to that publication, an integrated AM stereo decoder is already obtainable.

To identify the signal of a given stereo-broadcasting system, a low-frequency pilot tone that is characteristic of the system is transmitted with the carrier. It is filtered out and automatically turns on the receiver's stereo decoder. Such receivers are described in U.S. Pat. Nos. 4,302,626, 4,232,189 and 4,018,994. In the first-mentioned patent, it is stated that a pilot tone can be extracted by means of a digital filter. The invention uses exclusively digital filters which are generally known.

SUMMARY OF THE INVENTION

The invention thus relates to an integrable circuit for identifying a pilot tone from a limited number of pilot tones contained in an audio-frequency signal by means of pilot-tone filters which are tuned to the individual pilot tones and whose output signal control a logic circuit for performing one of the functions assigned to the individual pilot tones.

The object of the invention is to provide a monolithic integrable circuit of the above kind which gives high pilot-tone sensitivity and good pilot-tone selectivity (ability to distinguish between pilot-tone signals).

In a preferred embodiment of the integrable circuit according to the invention, a pair of audio-frequency signals is derived from a radio-frequency input signal by mixing the latter with two mutually orthogonal signals, e.g., $a_1 \cdot \sin wt$ and $a_2 \cdot \cos wt$, as is done during quadrature demodulation or, according to DE-OS No. 3,114,063 during demodulation in the baseband (intermediate frequency=0). In this preferred embodiment of the invention, this modulation takes place irrespective of the fact that an audio-frequency input signal may be present in which neither the pilot tone nor the audio-frequency component is quadrature-modulated. That is the case, for example, with a method as disclosed in the printed publication mentioned above. However, such multiplicative mixing has the advantage that the signals to be demodulated are quadrature-modulated signals placed in the baseband. At least one of these two signals is applied to the input of an analog-to-digital converter, so that digital identification of the pilot tone is ensured. In response to a signal from the logic circuit, the pair of these audio-frequency signals Xi and Xq can then be applied to a suitable analog pilot-tone filter by means of an electronic switch arrangement.

To this end, the output of the logic circuit controls an electronic switch arrangement whose switching elements apply the pair of audio-frequency signals to one of these decoders according to the output signal from the logic circuit.

All-digital signal processing circuitry is particularly suited to integration. To form such a circuit, the output of a first analog-to-digital converter is coupled to one of the two inputs of the electronic switch arrangement, and the second audio-frequency signal (Xi) is applied to the input of an additional analog-to-digital converter, which has its output connected to the outer input of the electronic switch arrangement. In this case, the signals of the pair of audio-frequency signals (Xi and Xq) are decoded digitally, i.e., using digital filters in similar fashion as for the identification of the pilot tone.

Instead of digital filters, the digital signal processor UDPI 01 (see "Elektronik" of Nov. 2, 1984, pages 143 to 151) can be used to decode the two digitized audio-frequency signals. It is capable of performing decoding operations according to each of the two pilot tones or to the decoding method used, i.e., to a decoding algorithm. The programs of the decoding algorithms and their constant multiplication factors can be accessed from a read-only memory of the processor and are selected by the logic circuit.

BRIEF DESCRIPTION OF THE DRAWING

The invention will be better understood from a reading of the following detailed description in conjunction with the drawing in which.

DETAILED DESCRIPTION

Figure 1:
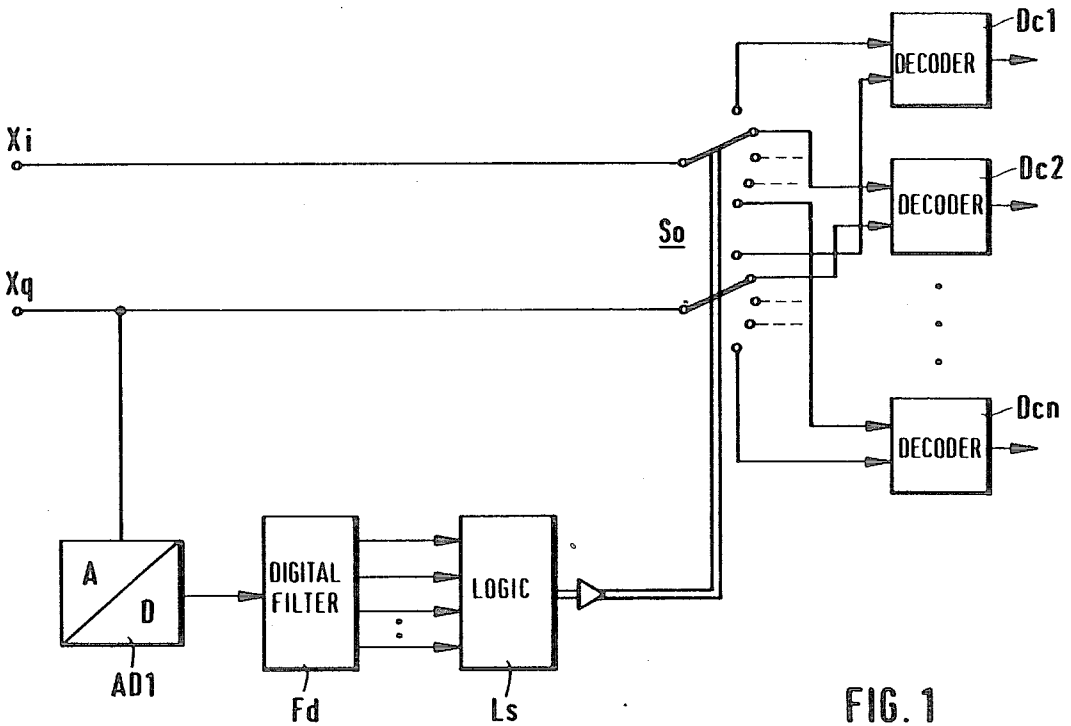
FIG. 1 is a block diagram of an integrable circuit according to the invention which makes it possible to identify and decode several differently encoded audio-frequency signals.

In the embodiment shown in the block diagram of FIG. 1, in which only the pilot tone and not the audio-frequency signals are processed digitally, the integrable circuit in accordance with the invention consists of the analog-to-digital converter ADl, the digital-filter arrangement Fd, and the logic circuit Ls. At least the digital-filter arrangement Fd and the logic circuit Ls should be integrated on a single chip. It is recommended to also form on this chip the analog-to-digital converter ADl and the electronic switch arrangement So, which contains a plurality of transistors.

According to a particularly advantageous feature of the circuit in accordance with the invention, a pair of audio-frequency signals Xi and Xq is formed from the radio-frequency input signal by multiplicatively mixing the input signal with two mutually orthogonal signals. One of these audio-frequency signals, e.g., the signal Xq, is applied to the input of the analog-to-digital converter ADl.

As shown in FIG. 1, the switch arrangement So permits each of the audio-frequency signals Xi and Xq to be applied to one input of each of the decoders Dcl to Dcn, which are disclosed in the U.S. patent specifications mentioned above.

The analog-to-digital converter ADl is of conventional design and, therefore, will not be described here. It delivers the digital values serially at a clock rate of, e.g., 10 kHz. These digital values are fed to the digital-filter arrangement of FIG. 2.

Figure 2:
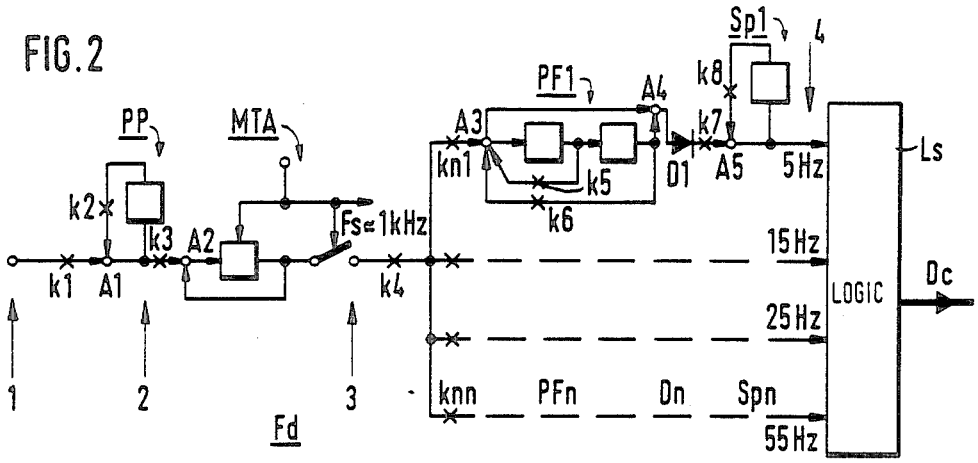
FIG. 2 is a block diagram of the circuit according to the invention without the analog-to-digital converter.

In FIG. 2, the X-symbols, which cross the conductors and at which coefficients kl to knn are placed, represent digital constant multipliers of conventional design whose coefficients are stored in a read-only memory. Digital adders are designated A1 to A5.

The pilot-tone-range filter PP, whose input is presented with the output signal of the analog-to-digital converter ADl, consists of a digital filter of simple design and a feedback multiplier with the coefficient k2, whose output value is added to the digital value of the multiplier with the coefficient k1 at the filter input by means of the adder A1. The multiplier with the coefficient k1 serves to limit the gain to 0 dB. The same applies to the multiplier with the coefficient k4 at the output of the averager MTA. The multiplication factor k2 of the multiplier of the pilot-tone-range filter PP gives a 3-dB cutoff frequency Fc of 100 Hz. Connected to the output of the multiplier with the multiplication factor k3 is the input of the adder A2 of the averager MTA (moving time averager). In this embodiment, the averager MTA is formed by a digital accumulator of conventional design which is clocked at the sampling frequency Fs of 1 kHz and can be implemented, for example, with a counter with feedback that is realized using flip-flop stages. Since the clock frequency of the analog-to-digital converter ADl of FIG. 1 is 10 kHz, the averager averages over 10 values as a result of the subsampling.

Figure 5:
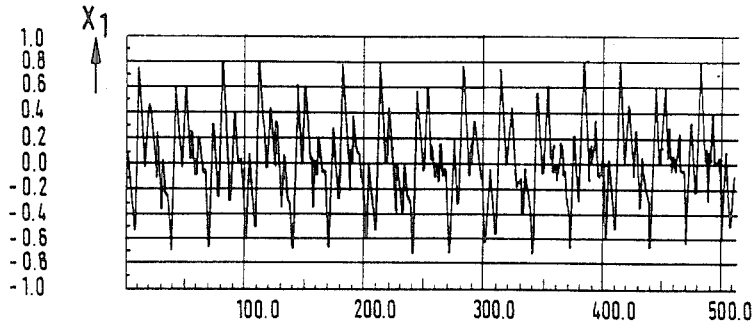
FIGS. 5 to 8 show the variations of the amplitudes of computer-simulated signals with time (in milliseconds, ms) at the circuit points 1, 2, 3 and 4 of FIG. 2 for a known coding method using a 25-Hz pilot tone.
Figure 6:
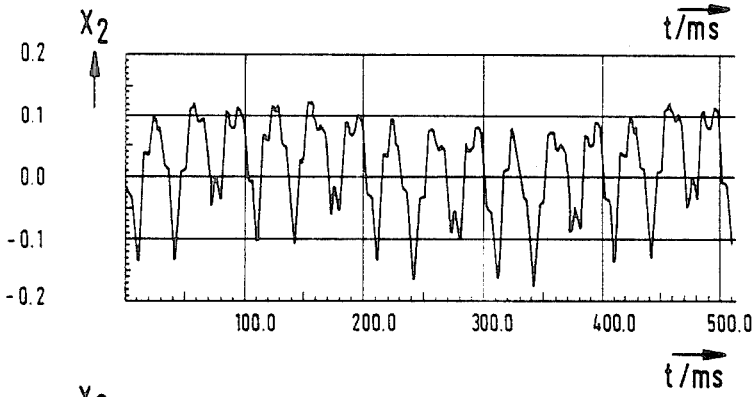
Figure 7:
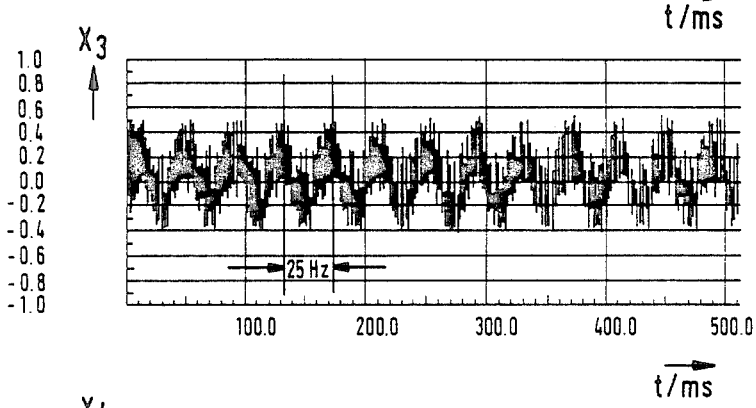
Figure 8:
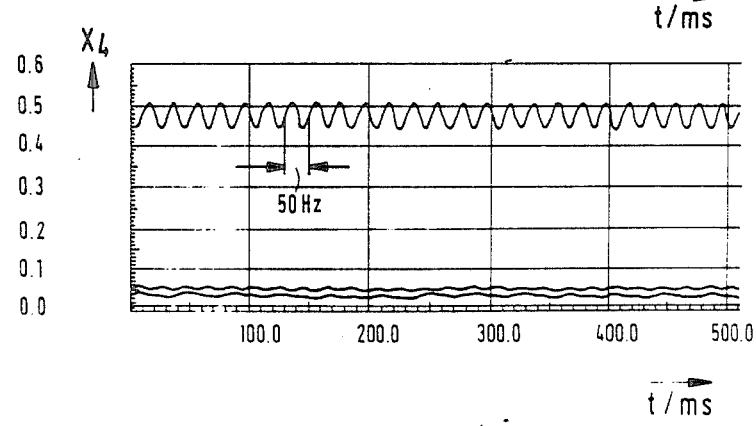

The operation of the arrangement consisting of the pilot-tone-range filter PP and the digital averager MTA follows from FIGS. 5 to 7, in which the potentials measured at points 1, 2 and 3 are plotted against time in milliseconds (ms) after digital-to-analog conversion. The curves clearly show the separation of the digitized audio signal applied to the input at 1 from a 25-Hz pilot tone, which is characteristic of one of the known stereo-broadcast techniques.

Figure 3:
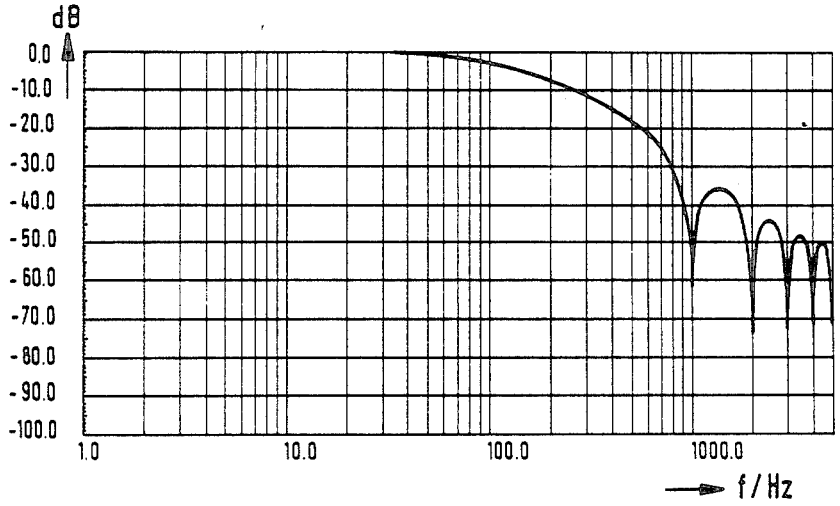
FIG. 3 illustrates the frequency response of the combination of a pilot-range filter and an averager.

FIG. 3 shows the amplitude-frequency response of the combination of the pilot-tone-range filter PP and the digital averager MTA and illustrates the prefiltering provided by this combination.

The output signal of the digital averager MTA is fed through the constant multiplier with the coefficient k4 and the level-normalizing constant multipliers with the coefficients knl through knn to the inputs of the digital pilot-tone filters (band-pass filters) PFl through PFn. The latter consist of the two delay elements in series (symbolized by squares) a portion of the output of each of which is fed back to the adder A3 at the input through constant multipliers with the coefficients k5 and k6, respectively. The adder at the input of each pilot-tone filter thus has three inputs, the first of which is the input of the pilot-tone filter. The second input is connected to the output of the constant multiplier with the coefficient k5, and the third input to the output of the constant multiplier with the coefficient k6. The output signal of the adder A3 is fed to the first delay line of the pilot-tone filter and to the first input of the adder A4 at the output of the pilot-tone filter. The second input of the adder A4 is fed with the output signal of the second delay line of the pilot-tone filter. A second-order digital pilot-tone filter as shown in FIG. 2 is especially suited for the pilot-tone-frequency range below 100 Hz.

Figure 4:
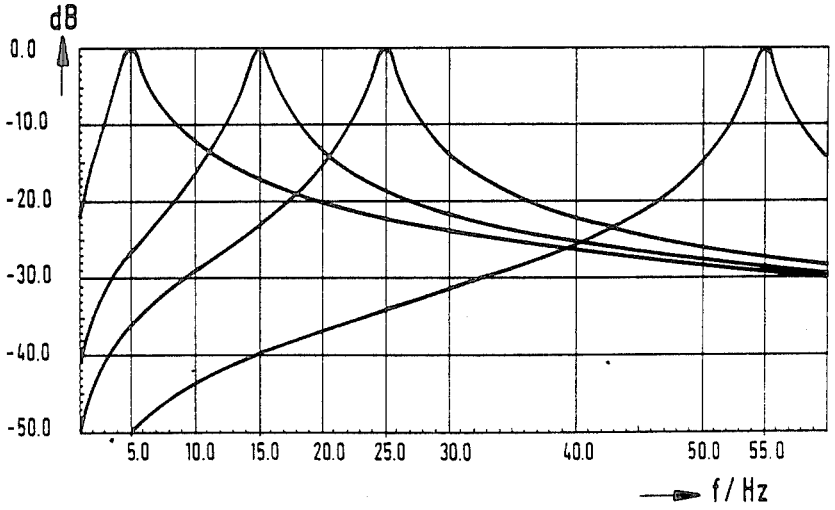
FIG. 4 shows the bandpass responses of four pilot-tone filters of the preferred embodiment for the 5-, 15-, 25-, and 55-Hz pilot-tone frequencies.

FIG. 4 shows the bandpass responses of the pilot-tone filters (band-pass filters) PFl . . . PFn used for the four pilot tones in this embodiment.

The output signals of the pilot-tone filters PFl to PFn are applied to the inputs of absolute-value stages Dl . . . Dn, respectively, which must be thought of as digital rectifiers. Such an absolute-value stage can be implemented in a known manner.

The output signal of each of the absolute-value stages Dl to Dn passes through a constant multiplier with the coefficient k7 and is applied to the input of a low-pass filter Spl, which consists of a delay line whose output is fed back to the adder A5 through the constant multiplier with the coefficient k8, as shown in FIG. 2.

Each of the combinations of an absolute-value stage and a low-pass filter (Tl, Spl; . . . Dn, Spn) thus determines the energy of each of the pilot-tone signals and forms a level which is fully sufficient to convey to the logic circuit Ls unambiguous information for switching to the appropriate decoder of the decoders Dcl to Dcn of FIG. 1.

Figure 9:
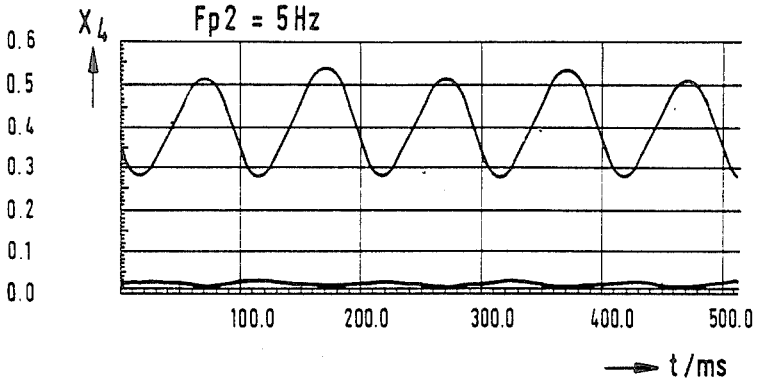
FIGS. 9 to 11 show corresponding output signals at the circuit point 4 for three other known methods using pilot tones with the frequencies Fp2=5 Hz, Fp3=15 Hz, and Fp4=55 Hz.
Figure 10:
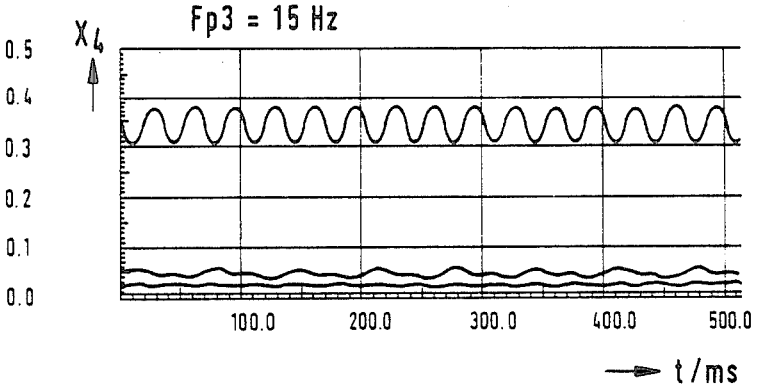
Figure 11:
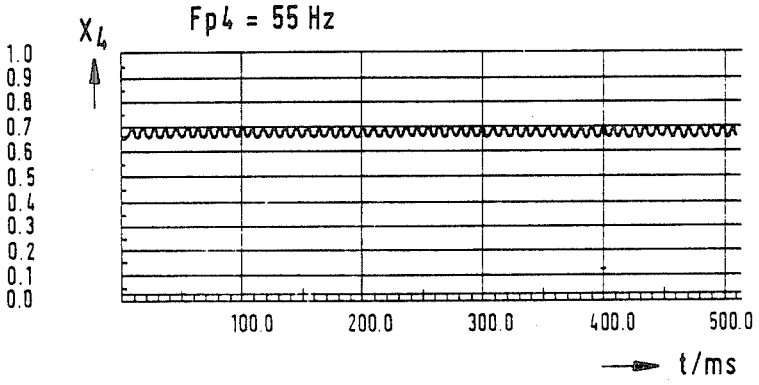

For the other modulation methods usable in this embodiment, each of FIGS. 9 to 11 shows the signal in the presence of one of the other pilot-tone signals with the frequencies Fp2=5 Hz (FIG. 9), Fp3=15 Hz (FIG. 10), and FP4=55 Hz (FIG. 11) in relation to the signal levels of the respective three other pilot tones. The average level of the pilot-tone signal at point 4 of the circuit of FIG. 2 thus always exceeds three times the value of the level of the other three pilot-tone signals.

Figure 12:
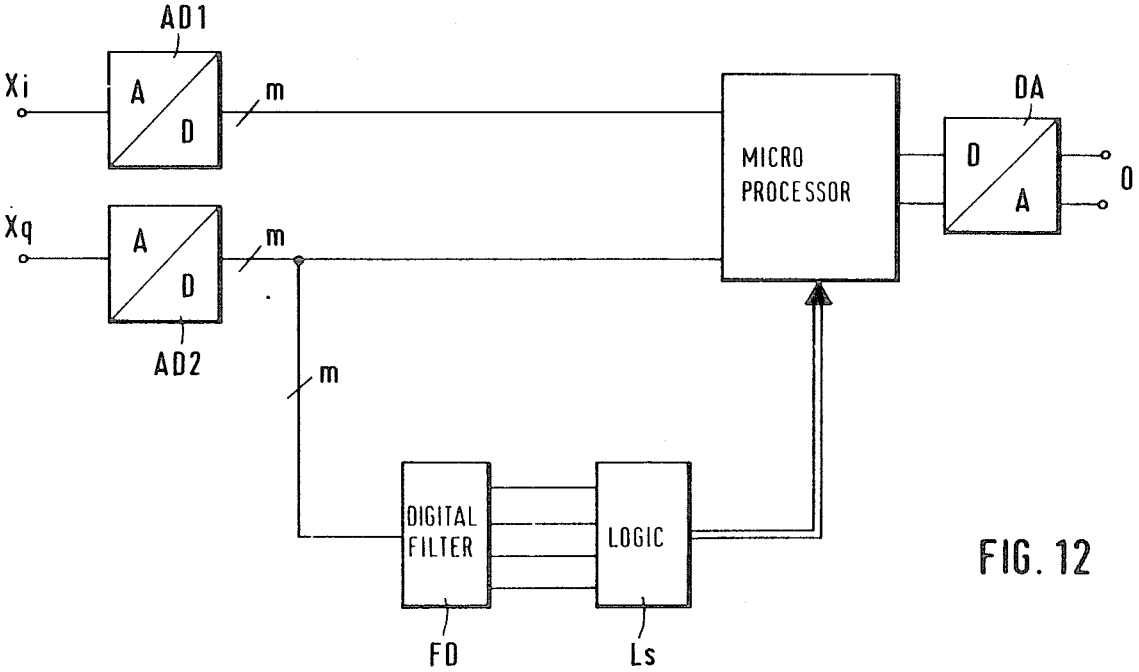
FIG. 12 shows a preferred embodiment of the integrable circuit using a microprocessor which decodes the digitized signals of two audio channels according to the identified pilot tone.

Since the integrable circuit according to the invention of FIG. 1 uses an analog-to-digital converter ADl to digitally identify a pilot tone, and since neither the pilot tone nor the audio signals can be transmitted using quadrature modulation, in a further embodiment of the circuit according to the invention, the first signal of a pair of audio frequency signals is derived by multiplicatively mixing a radio-frequency input signal with one of two mutually orthogonal radio-frequency signals, and applied to the input of the analog-to-digital converter ADl, whose output is connected to the input of the sampling averager MTA via the digital pilot-tone-range filter PP. If the second signal of the pair of audio-frequency signals is derived in the same manner, as is the case in the method disclosed in the above-mentioned DE-OS No. 31 14 063, this has the advantage that in the presence of both quadrature-modulated radio-frequency input signals and non-quadrature-modulated signals, quadrature-modulated audio-frequency signals Xi and Xq appear at the switch arrangement So of FIG. 1, so that the decoders Dc to Dcn can be of uniform design. Then, a pair of quadrature-modulated signals Xi and Xq will be present at the integrable circuit according to the invention even if neither the stereo signal nor the pilot-tone signal is quadrature-modulated. Preferably, a second analog-to-digital converter digitizes the quadrature signal Xi of FIG. 1, and the output of the first analog-to-digital converter ADl is connected to the switch arrangement So, too, so that the decoders Dcl to Dcn have to process only pairs of digitized input signals. In this case, digital filters can be used, which are better suited for integration. This also makes possible the preferred embodiment of the integrable circuit shown in FIG. 12.

There, the filters Dcl to Dcn for decoding the audio-frequency signal are replaced by a signal processor with which digital filtering can be performed. The constant multiplication factors and decoding algorithms assigned to the pilot tones can be withdrawn from a read-only memory. The logic circuit Ls thus delivers a signal which selects in the signal processor the decoding algorithm and the associated constant multiplication factors stored there. Such a processor is described, for example, in the Nov. 2, 1984 issue of "Elektronik", pages 143 to 151.

It is not necessary, of course, to process the digitized pilot-tone signal with the same word length as is necessary with the audio signal. To save chip area, 16-bit analog-to-digital converters AD1 and AD2 were therefore used in the embodiment of FIG. 12. The word length of a coefficient is 10 bits.

What is claimed is:

1. A circuit for identifying a pilot from a limited number of pilot tones contained in an audio frequency signal and wherein each said pilot tone corresponds to preassigned functions, said circuit comprising:

an analog-to-digital converter receiving said audio frequency signal;

a subsampling digital averager;

a digital-tone-range filter coupling the output of said analog-to-digital converter to the input of said subsampling digital averager;

a plurality of digital pilot tone filters each having its input coupled to the output of said averager and each providing an output when a corresponding one of said pilot tones occurs;

a plurality of absolute value stages each having its input coupled to the output of a corresponding one of said digital pilot tone filters;

a plurality of low pass filters each having its input coupled to the output of a corresponding one of said absolute value stages; and circuit means responsive to the outputs of said plurality of low pass filters for selectively enabling the performance of the functions assigned to said pilot tones.

2. A circuit in accordance with claim 1, comprising:

a constant multiplier coupled between said digital tone range filter and said plurality of digital pilot tone filters.

3. A circuit in accordance with claim 2, wherein:

said audio frequency signal is derived by multiplicatively mixing a radio-frequency input signal with one of two mutually orthogonal signals.

4. A circuit in accordance with claim 1, wherein:

said audio frequency signal is derived by multiplicatively mixing a radio-frequency input signal with one of two mutually orthogonal signals.

5. A circuit in accordance with claim 3, comprising:

an electronic switch arrangement controlled by the output of said circuit means;

a plurality of decoders coupled to the outputs of said electronic switch arrangement;

said electronic switch having a first input receiving said audio frequency signal and a second input receiving a second audio frequency signal;

said audio frequency signal and said second audio frequency signal being coupled through said electronic switch to a selected one of said plurality of decoders.

6. A circuit in accordance with claim 5, comprising:

a second analog to digital converter receiving a second analog audio signal; and a microprocessor having inputs receiving the outputs of said analog-to-digital converter and said second analog-to-digital converter;

said microprocessor being responsive to said circuit means for decoding the signals of a plurality of different coded modulation methods.

7. A circuit in accordance with claim 6, wherein:

said microprocessor includes a read only memory.

8. A circuit for identifying a pilot from a limited number of pilot tones contained in an audio frequency signal and wherein each said pilot tone corresponds to preassigned function, said circuit comprising;

an analog-to-digital converter receiving said audio frequency signal;

a subsampling digital averager;

a digital-tone-range filter coupling the output of said analog-to-digital converter to the input of said subsampling digital averager;

a digital pilot tone filter having its input coupled to the output of said averager;

an absolute value stage having its input coupled to the output of said digital pilot tone filter;

a low pass filter having its input coupled to the output of said absolute value stage; and circuit means responsive to the output of said low pass filter for enabling the performance of the function assigned to said pilot tone.

9. A circuit in accordance with claim 8, comprising:

a constant multiplier coupled between said digital tone range filter and said digital pilot tone filter.

10. A circuit in accordance with claim 9, wherein:

said audio frequency signal is derived by multiplicatively mixing a radio-frequency input signal with one of two mutually orthogonal signals.

11. A circuit in accordance with claim 8, wherein:

said audio frequency signal is derived by multiplicatively mixing a radio-frequency input signal with one of two mutually orthogonal signals.

* * * * *